United States Patent [19]

Skalsky et al.

[11] Patent Number: 4,936,079

[45] Date of Patent: Jun. 26, 1990

[54] SUPPORT FOR ROLL OF WRAPPING MATERIAL AND BRAKE FOR SAME

[75] Inventors: Ronald J. Skalsky, Kirtland; William C. Lynch, Brecksville, both of Ohio

[73] Assignee: Heat Sealing Equipment Manufacturing Co., Cleveland, Ohio

[21] Appl. No.: 279,827

[22] Filed: Dec. 5, 1988

[51] Int. Cl.[5] ..... B65B 11/48; B65B 67/10; B65H 18/20

[52] U.S. Cl. ..... 53/219; 53/389; 53/390; 242/68.7; 242/75.4; 242/78.7

[58] Field of Search ..... 53/219, 389, 390; 242/75.4, 68.7, 78.7

[56] References Cited

U.S. PATENT DOCUMENTS

| | | | |
|---|---|---|---|
| 2,987,864 | 6/1961 | Miller | 53/390 |
| 3,043,071 | 7/1962 | Sadell | 53/390 |
| 3,394,897 | 7/1968 | Martin, Sr. | 242/78.7 |
| 3,468,529 | 9/1969 | Martin, Sr. et al. | 242/68.7 |
| 3,552,091 | 1/1971 | Johnston, III et al. | 53/390 X |
| 3,595,456 | 7/1971 | Rosenthal | 53/390 X |
| 3,800,499 | 4/1974 | Feldman | 53/219 X |
| 4,141,516 | 2/1979 | Olson | 242/75.4 X |
| 4,557,102 | 12/1985 | Ikemoto | 53/219 X |
| 4,712,459 | 12/1987 | Walkiewicz, Jr. et al. | 53/390 X |

*Primary Examiner*—Robert L. Spruill
*Assistant Examiner*—Beth Bianca
*Attorney, Agent, or Firm*—James A. Hudak

[57] ABSTRACT

A wrapping material roll support assembly which supports the roll of wrapping material within the wrapping device and permits easy placement of the roll of wrapping material thereon. Two spaced apart parallel rollers support the roll or wrapping material by contacting the outer circumference thereof. An adjustable tension brake frictionally engages the parallel rollers which support the roll of wrapping material. By adjusting the tension provided by the brake, undesired unrolling of the free end of the roll of wrapping material can be prevented. A safety catch is received through the core of the roll of wrapping material preventing the roll from falling from the roll support assembly.

10 Claims, 4 Drawing Sheets

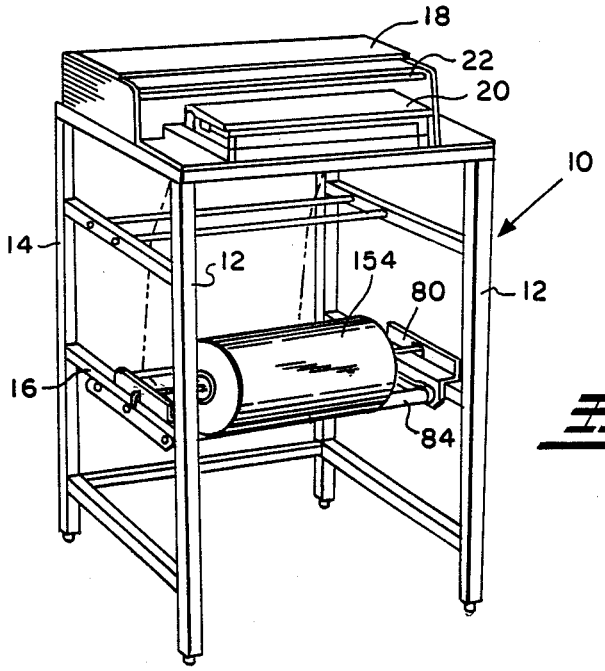
Fig. 3
Fig. 4
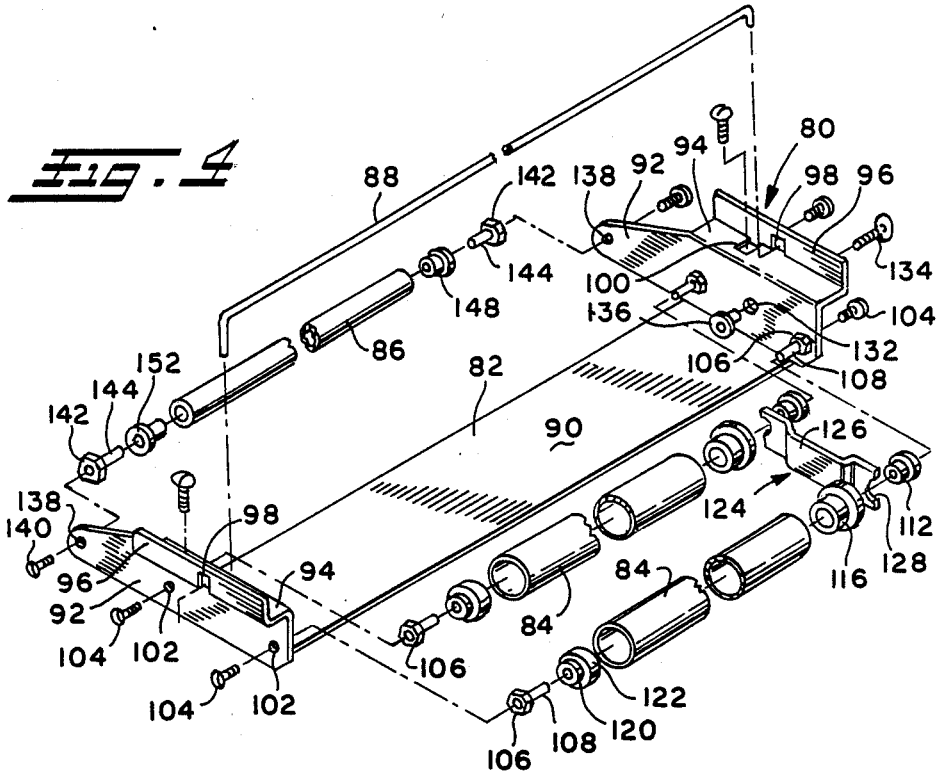

SUPPORT FOR ROLL OF WRAPPING MATERIAL AND BRAKE FOR SAME

TECHNICAL FIELD

The present invention relates generally to devices for wrapping meat and/or produce and more particularly to a wrapping device that incorporates a brake to prevent the undesired unrolling of a roll of wrapping material supported thereon.

BACKGROUND ART

Various devices are available for wrapping produce and/or meats for retail sale purposes. Typically, these wrapping devices utilize a roll of wrapping material which is supported thereon, a wrapping platform, an electrical heat severing rod or wire and a heat sealing platform. After the article has been wrapped, the heat severing rod or wire is used to sever the wrapping material and the wrapped article is placed on the heat sealing platform for sealing purposes. In general, these wrapping devices have a number of inherent common disadvantages. For example, the loading of a new roll of wrapping material requires the insertion of a shaft through the core of roll of wrapping material, the insertion of oppositely disposed end caps on the shaft into the ends of the roll of wrapping material, the loosening of cap members and mating bearing blocks on the wrapping device to accommodate the ends of the shaft supporting the roll of wrapping material, the lifting of the shaft and roll of wrapping material and placement of same onto the bearing blocks on the device, and the tightening of the cap members and bearing blocks to retain the shaft and the roll of wrapping material on the device. Because of this, loading of a roll of wrapping material into the wrapping device is a time consuming operation. In addition, since the shaft is received through the core of the roll of wrapping material before loading into the wrapping device, the resulting assembly of shaft and roll of wrapping material is quite heavy and cumbersome causing some operators to have difficulty in placing the assembly within the wrapping device. Lastly, most of the presently available wrapping devices do not include adequate brake means to maintain the free end of the roll of wrapping material taut in order to prevent the undesired unrolling of same. Such undesired unrolling of the roll of wrapping material results in the wrapping material "doubling back on itself" within the wrapping device causing machine downtime, loss of production and waste of wrapping material.

Because of the foregoing, it has become desirable to develop apparatus for preventing the undesired unrolling of a roll of wrapping material and for permitting the easy insertion of the roll into a wrapping device.

SUMMARY OF THE INVENTION

The present invention solves the problems associated with the prior art and other problems by providing a wrapping material roll support assembly which supports a roll of wrapping material within the wrapping device and permits the easy placement of the roll of wrapping material thereon. The roll support assembly is comprised of two spaced apart parallel rollers which support the roll of wrapping material by contacting the outer circumference thereof. In this manner the roll of wrapping material is "cradled" between the two parallel rollers. The roll support assembly also includes an adjustable tension brake which frictionally engages the rollers which "cradle" the roll of wrapping material. By adjusting the tension provided by the brake, undesired unrolling of the roll of wrapping material can be prevented. A safety catch is received through the core of the roll of wrapping material preventing the roll from accidently falling from the roll support assembly when the wrapping device is in use.

BRIEF DESCRIPTION OF THE DRAWINGS

FIG. 3 is a perspective view of a conventional wrapping machine utilizing the present invention to support a roll of wrapping material thereon.

FIG. 4 is an exploded perspective view of the present invention shown in FIG. 3.

FIG. 6 is a front elevation view of the present invention shown in FIG. 4.

DESCRIPTION OF THE PREFERRED EMBODIMENT

Figure 1:
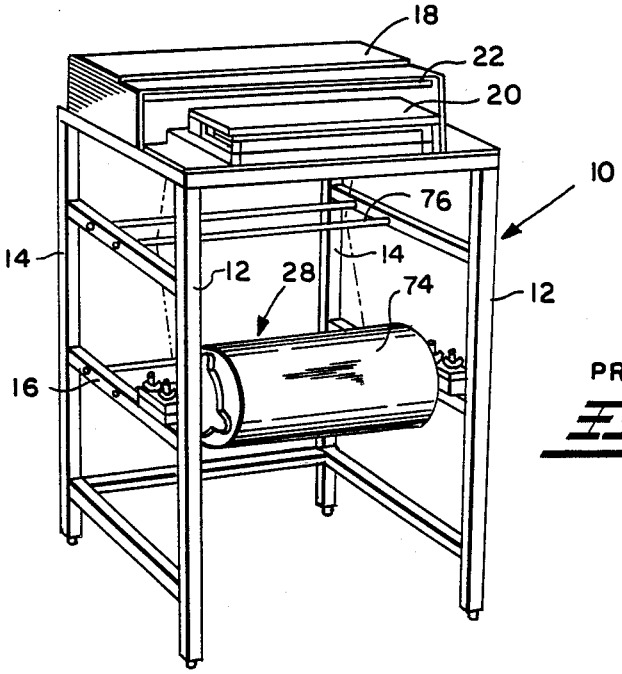
PRIOR ART FIG. 1
FIG. 1 is a perspective view of a conventional wrapping machine utilizing a prior art apparatus for supporting a roll of wrapping material thereon.

Referring now to the drawings where the illustrations are for the purpose of describing the preferred embodiment of the present invention and are not intended to limit the invention hereto, FIG. 1 is a perspective view of a conventional wrapping machine 10 utilizing a prior art apparatus for supporting a roll of wrapping material thereon. The wrapping machine 10 includes a frame having front legs 12, rear legs 14 and a plurality of horizontal frame members 16 that are substantially rectangular in cross-section, are parallel to one another and are connected to the front and rear legs on opposite sides of the frame. A wrapping platform 18 is positioned adjacent the upper rear portion of the frame, an electric heat sealing platform 20 is positioned adjacent the upper front portion of the frame and an electric heat severing rod or wire 22 is mounted on the frame and positioned so as to be longitudinally intermediate the wrapping platform 18 and the heat sealing platform 20. The wrapping platform 18 has a plurality of parallel transverse slots (not shown) extending vertically therethrough. A rod (not shown) is positioned adjacent each of the transverse slots and acts as a guide for the wrapping material which passes through the associated transverse slot.

Figure 2:
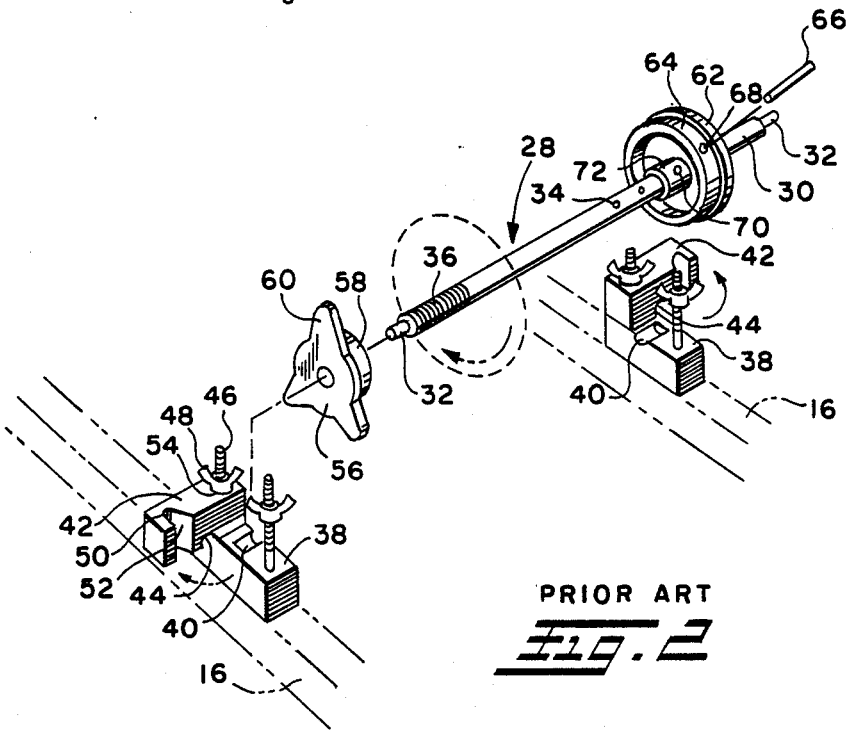
PRIOR ART FIG. 2
FIG. 2 is an exploded perspective view of the prior art apparatus shown in FIG. 1 for supporting the roll of wrapping material within the wrapping machine.
Figures 5, 5A:
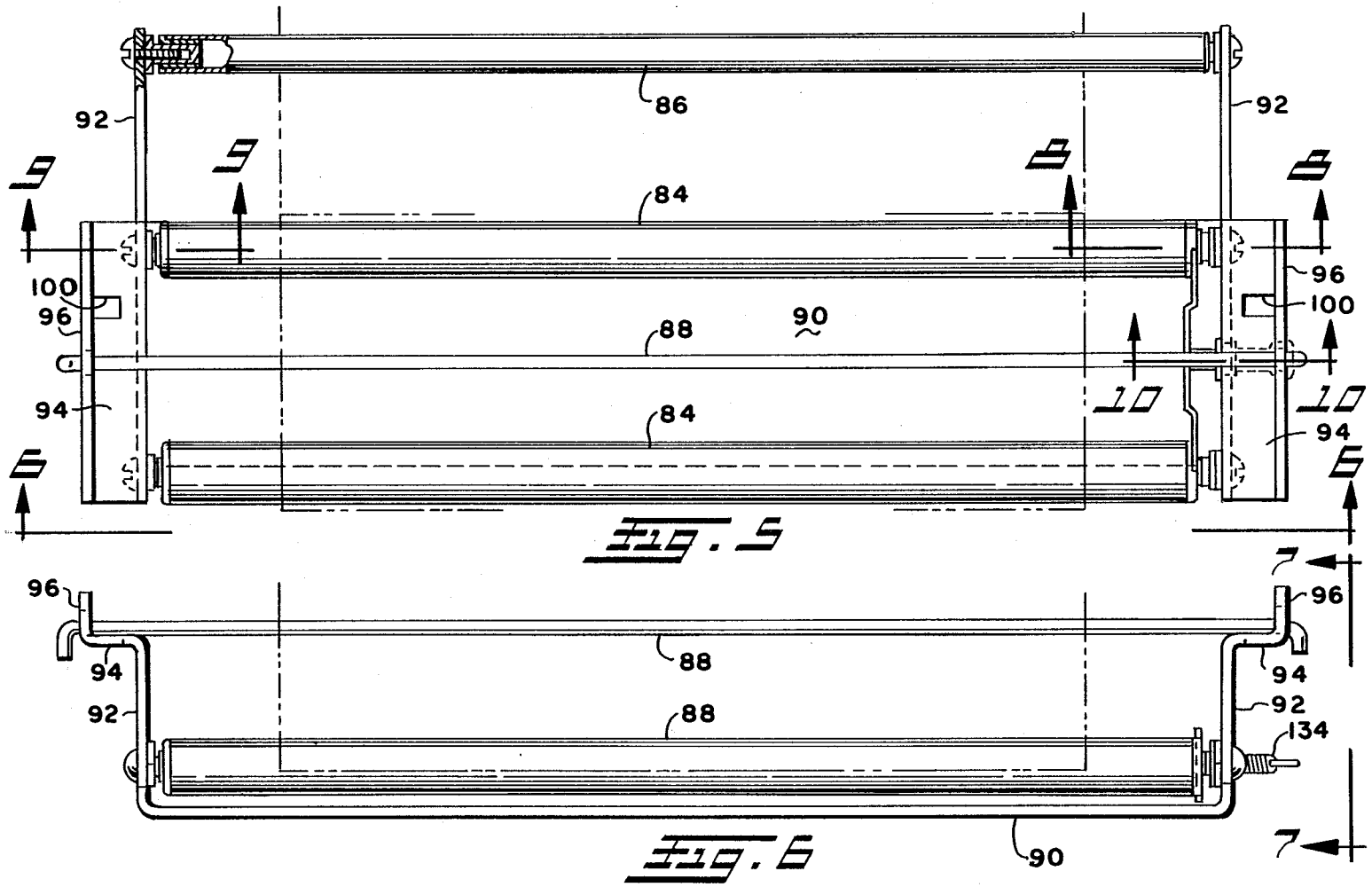
FIG. 5 is a top plan view of the present invention shown in FIG. 4.

The prior art wrapping material roll supporting assembly, shown generally by the numeral 28 in FIG. 2, includes an elongated transverse shaft 30 having reduced diameter opposite end portions 32. The shaft 30 has a plurality of spaced apart cross-drilled holes 34 passing transversely therethrough adjacent one end thereof. Threads 36 are provided adjacent the opposite end of the shaft 30 for a portion of the longitudinal length thereof. A bearing block 38 having an upwardly directed notch 40 in its top surface is mounted on opposite horizontal frame members 16 so as to be positioned thereabove. The reduced diameter opposite end portions 32 of the shaft 30 are positioned in the upwardly directed notches 40 of the bearing blocks 38, and cap members 42, having complementary downwardly directed notches 44 therein, are received on each of the bearing blocks 38 so as to retain each of the end portions 32 therebetween. A pair of bolts 46 is received through aligned apertures in the frame members 16, the bearing blocks 38 and cap members 42 and each bolt threadedly engages a wing nut 48 located adjacent the top surface of the cap member 42 in a conventional manner to clamp the end portion 32 of the transverse shaft 30. It should be noted that aperture 50 in each cap member 42 has an outwardly directed slot 52 emanating therefrom and positioned so as to permit limited rotation of the cap member 42 about aperture 54 therein.

An internally threaded end cap 56 is received on the shaft 30 and engages the threads 36 thereon. The end cap 56 has an inwardly directed circumferential surface 58 having an outer diameter which approximates the inner diameter of the core of the roll of wrapping material to be used, and has a plurality of evenly spaced ears 60 positioned about its outer periphery. Similarly, a fixed end cap 62 is received on the shaft 30 and positioned so as to be oppositely disposed from internally threaded end cap 56. The fixed end cap 62 has an inwardly directed circumferential surface 64 having an outer diameter which approximates the inner diameter of the core of wrapping material, and is attached to the shaft 30 by means of a pin 66 which passes through aligned bores 68 and 70 in the circumferential surface 64 and the hub 72, respectively, of the fixed end cap 62 and through the appropriate cross-drilled hole 34 in the shaft 30. The roll 74 of wrapping material is suspended on the shaft 30 by slipping one end of its core over the circumferential surface 64 on the fixed end cap 62 and then threadedly advancing the internally threaded end cap 56 on shaft 30 so that the circumferential surface 58 thereon is received in the other end of the core of the roll of wrapping material. The foregoing is accomplished by gripping the ears 60 on the internally threaded end cap 56 and rotating the end cap with respect to the shaft 30. The web (free end portion) of the roll 74 of wrapping material extends upwardly and adjacent transverse guide rods 76 mounted on the horizontal frame member 16 and the guide rod positioned adjacent the transverse slot being utilized in the wrapping platform 18. The web passes adjacent the electric heat severing rod or wire 22 so as to be available for wrapping the meat or produce on the wrapping platform 18. The electric heat severing rod or wire 22 is used for severing the material to the desired length for wrapping purposes. After wrapping has been accomplished, the wrapped article is placed on the heat sealing platform 20 to seal same.

The foregoing prior art apparatus has a number of inherent disadvantages. For example, loading of a new roll of wrapping material onto the wrapping machine requires inserting the shaft 30 through the core of the roll 74 of wrapping material so that circumferential surface 64 in fixed end cap 62 is received in one end of the core, rotating the internally threaded end cap 56 on the shaft 30 so as to advance same until its circumferential surface 58 is received within the other end of the core of wrapping material, loosening the wing nuts 48 on the bolts 46 so as to permit the cap members 42 to be rotated outwardly with respect to their complementary bearing blocks 38, lifting the shaft 30 with the roll 74 of wrapping material suspended thereon and placing same within the wrapping machine so that the bottom surface of each end portion 32 of the shaft 30 is received within the upwardly directed notch 40 within a bearing block 38, rotating the cap members 42 inwardly with respect to their complementary bearing blocks 38 so that the downwardly directed notch 44 within each cap member 42 is received over the top surface of the end portion 32 of the shaft 30, and tightening the wing nuts 48 on the bolts 46 so that the upwardly directed notch 40 and the downwardly directed notch 44 in the bearing block 38 and cap member 42, respectively, grippingly engage the end portion 32 of the shaft 30 positioned therebetween. In view of the foregoing number of operations that are required in order to load a new roll of wrapping material into the wrapping machine, the loading process is a time consuming operation. In addition, since the shaft is received through the core of the roll of wrapping material before loading into the wrapping machine, the resulting assembly of the shaft and roll of wrapping material is quite heavy and cumbersome causing some operators to have difficulty in placing the assembly within the wrapping machine.

Another inherent disadvantage associated with this prior art apparatus is that the surfaces defining the upwardly directed notch 40 and the downwardly directed notch 44 in the bearing block 38 and cap member 42, respectively, are also utilized to act as a brake on the shaft 30. A brake is required in order to keep the web of wrapping material taut so that undesired unrolling of the roll of wrapping material is prevented. Such undesired unrolling of the roll of wrapping material results in the material "doubling back on itself" within the wrapping machine causing machine downtime, loss of production and waste of wrapping material. With respect to the foregoing prior art approach to provide a brake for the shaft 30, it has been found that constant adjustment of same is required by turning of the wing nuts 48 on the bolts 46 to compensate for wear within the notches 40 and 42 by the shaft 30, and that when wear within these notches 40 and 42 exceeds the limit which can be "taken up" by threadedly advancing the wing nuts 48 on their respective bolts 46, braking action on the shaft 30 ceases preventing the web of wrapping material from being kept taut and permitting the undesired unrolling of the roll of wrapping material.

Referring now to FIG. 3, the horizontal frame members 16 are utilized to mount the wrapping roll support assembly, shown generally by the numeral 80, of the present invention. The wrapping roll support assembly 80 has been mounted on the frame of the wrapping machine 10 in place of the roll support assembly 28 of the prior art. Referring now to FIG. 4, the wrapping roll support assembly 80 includes a mounting plate 82, two spaced apart parallel rollers 84, a guide roller 86, and a safety catch 88. The mounting plate 82 is formed from a metallic material, such as aluminum, and includes a central portion 90, oppositely disposed side members 92, a support edge 94 attached to each side member 92, and a safety catch engaging member 96 attached to each support edge 94. The oppositely disposed side members 92 are substantially perpendicular to the central portion 90 of the plate 82, whereas each support edge 94 is substantially parallel to the foregoing central portion 90 of the plate 82. Each safety catch engaging member 96 is substantially perpendicular to the adjacent support edge 94. A notch 98 is provided in each safety catch engaging member 96 to receive the safety catch 88. An aperture 100 is provided in each support edge 94 to permit attachment of the roll support assembly 80 to the frame of the wrapping machine, as later described The length of the rollers 84 is sufficient to accommodate a roll of wrapping material thereon.

Two apertures 102 are provided in each side member 92 and are positioned so as to be oppositely aligned with similar apertures 102 in the opposite side member 92 so that the rollers 84, when supported between aligned apertures 102, are substantially parallel to one another. The axis between adjacent apertures 102 in each side member 92 is also substantially parallel to the horizontal frame member 16 when the wrapping roll support assembly 80 is placed thereon. The horizontal spacing between the foregoing apertures 102 is such that the rollers, 84, when supported therebetween, are properly spaced to support ("cradle") a roll of wrapping material therebetween. A threaded fastener 104 is received in each of the apertures 102 and threadedly engages a roller support member 106 which is positioned on the inner side of the side member 92. The roller support member 106 has a longitudinally extending shank 108 having a cylindrical configuration. The longitudinally extending shank 108 of each roller support member 106 adjacent one of the side members 92 is received within the bore of a nylon bushing 112. The nylon bushing 112, in turn, is received within the bore of a cylindrical nylon end cap 116 which is received within one end of the rollers 84. The longitudinally extending shank 108 of each roller support member 106 adjacent the other side member 92 is received within the bore of a ball bearing 120 whose outer race is formed within a cylindrical metallic end cap 122 which is received within the opposite end of the rollers 84. Thus, one end of the rollers 84 has a nylon end cap 116 thereon, whereas the other end of the rollers 84 is provided with a metallic end cap 122. In any event, each end of the rollers 84 is supported by a roller support member 106 received therein and attached to the adjacent side member 92 by a fastener 104.

A tension brake 124 is comprised of a metallic strip 126 having semi-circular cutouts 128 at opposite ends thereof to receive the fasteners 104 which are utilized to support one end of the rollers 84. The spacing between the centers of the semi-circular cutouts 128 corresponds to the spacing between the apertures 102 in the side member 92 through which the fasteners 104, which are utilized to support the rollers 84, are received. The approximate center of the metallic strip 126 forming the tension brake 124 is bowed inwardly. The tension brake 124 is positioned so that the surfaces adjacent the semi-circular cutouts 128 contact the outer surface of the nylon end caps 116 in the rollers 84, and so that the concave side of the bow is adjacent the inner side of the adjacent side member 92. An aperture 132 is provided in the side member 92 adjacent the tension brake 124 and is positioned so as to be substantially coincident with the approximate center of the concave side of the metallic strip 126 forming the brake. A thumb screw 134 is received through a threaded fastener 136 received within aperture 132 in side member 92. The tip of thumb screw 134 contacts the surface of the concave side of the bow in the metallic strip 126 forming the tension brake 124. By threadedly advancing the thumb screw 134 within the fastener 136, the surfaces adjacent the semi-circular cutouts 128 in the metallic strip 126 forming the tension brake 124 frictionally engage the outer surface of the nylon end caps 116 minimizing the "free-wheeling" of the rollers 84.

An aperture 138 is provided adjacent the rear of each side member 92 and positioned therein so as to be aligned with one another. A threaded fastener 140 is received in each of the apertures 138 and threadedly engages a roller support member 142 which is positioned on the inner side of the side member 92. The roller support member 142 has a longitudinally extending shank 144 having a cylindrical configuration. The longitudinally extending shank 144 of the roller support member 142 adjacent one side member 92 is received within the bore of a cylindrical nylon end cap 148 which is received within one end of the guide roller 86. The longitudinally extending shank 144 of the roller support member 142 adjacent the other side member 92 is received within the bore of a cylindrical metallic end cap 152 which is received within the other end of the guide roller 86. Thus, one end of the guide roller 86 has a nylon end cap 148 therein, whereas the other end of the guide roller 86 is provided with a metallic end cap 152. The guide roller 86 is utilized to direct the web of wrapping material away from its dispensing roll toward the transverse slot that is being utilized in the wrapping platform 18.

Figure 7:
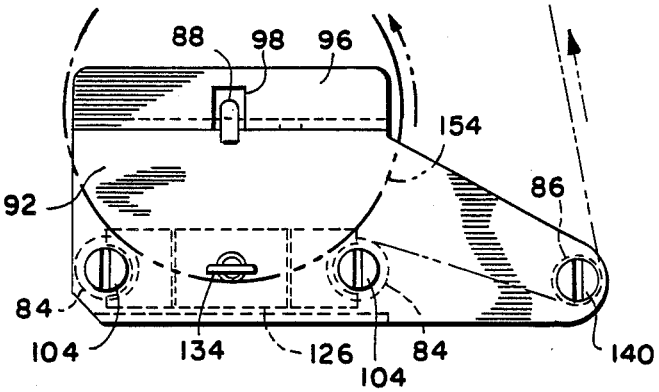
FIG. 7 is a right end view of the present invention shown in FIG. 4.
Figure 8:
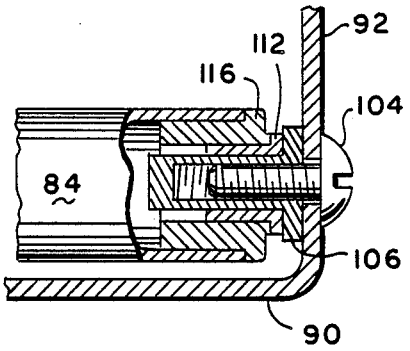
FIG. 8 is a cross-sectional view taken along section indicating lines 8—8 of FIG. 5.
Figure 9:
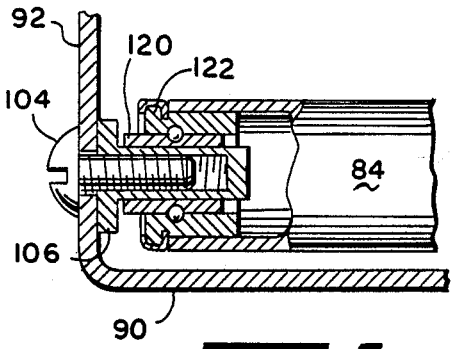
FIG. 9 is a cross-sectional view taken along section indicating lines 9—9 of FIG. 5.
Figure 10:
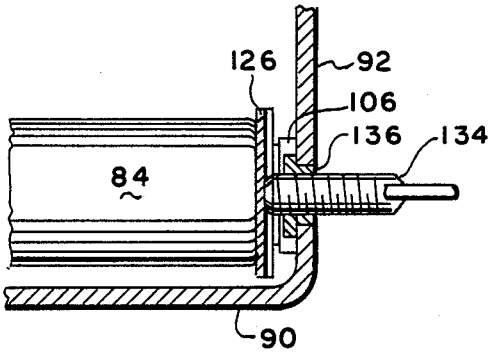
FIG. 10 is a cross-sectional view taken along section indicating lines 10—10 of FIG. 5.

The wrapping roll support assembly 80 replaces the prior art material roll support assembly 28 on the wrapping machine 10. It is attached to the horizontal frame members 16 by means of bolts which pass through apertures provided therein and which were used to secure the prior art wrapping material roll support assembly 28 to the wrapping machine 20. The bolts used to secure the wrapping roll support assembly 80 to the horizontal frame members 16 pass through apertures 100 provided in the support edge 94 of the mounting plate 82. A roll 154 of wrapping material is placed on the rollers 84 so as to be supported by same. The safety catch 88 is then inserted through the core of the roll 154 of wrapping material and each of its outer ends engages a notch 98 provided in the safety catch engaging member 96. In this manner, the roll 154 of wrapping material is supported by the rollers 84 and cannot roll off of the wrapping roll support assembly 80. Once placed on the wrapping roll support assembly 80, the free end of the roll of wrapping material is allowed to pass under the centrally located roller 84, as shown in FIG. 7, and then passes on the outer side of guide roller 86. In this manner, the free end of the wrapping material is guided toward the transverse slot being utilized in the wrapping platform 18. In order to increase tension, i.e., frictional engagement of the tension brake 124 on the rollers 84, the thumb screw 134 is threadedly advanced into fastener 136 thus causing axial movement of the metallic strip 126 forming the tension brake 124 against the nylon end caps 116 in the rollers 84. Conversely, in order to reduce tension, i.e., frictional engagement of the tension brake 124 on the rollers 84, the thumb screw 134 is threadedly withdrawn from the fastener 136 causing the metallic strip 126 forming the tension brake 124 to move axially away from the nylon end caps 116 on the rollers 84.

The present invention offers a number of advantages over the prior art apparatus for supporting a roll of wrapping material. For example, the loading of a roll of wrapping material merely requires placing the roll 154 on the rollers 84. Even though the roll 154 of wrapping material is placed upon the rollers 84, it cannot drop off of the roll support assembly 80 or the wrapping machine 10 because of the use of the safety catch 88 which passes through the core of the roll 154 of wrapping material. Undesired unrolling of the roll 154 of wrapping material cannot occur because of the frictional engagement of the tension brake 124 against the nylon end caps 116 in the ends of the rollers 84. This frictional engagement is easily adjustable to vary the tension applied to the ends of the rollers 84. Thus, the wrapping roll support assembly 80 of the present invention provides a simple approach for the placement and support of a roll of wrapping material in the wrapping machine, and provides means for preventing the undesired unrolling of the roll of wrapping material.

Certain modifications and improvements will occur to those skilled in the art upon reading the foregoing. It should be understood that all such modifications and improvements have been deleted herein for the sake of conciseness and readability, but are properly within the scope of the following claims.

We claim:

1. Apparatus for supporting a roll of wrapping material within a wrapping device comprising a base member having a central portion and oppositely disposed outwardly directed end portions which engage the frame of the wrapping device to support said base member within the wrapping device, a plurality of roll members attached to said base member, said roll members being in a substantially spaced apart parallel relationship to one another and supporting the roll of wrapping material thereon, a guide member attached to said base member for directing the free end of the roll of wrapping material within the wrapping device, and brake means attached to said base member and operatively engaging at least one of said roll members to control the rotation thereof, said brake means being responsive to the application of a force thereto to vary the engagement thereof with said at least one of said roll members.

2. The apparatus as defined in claim 1 wherein said guide member is substantially parallel to said plurality of roll members and has a substantially smooth surface.

3. The apparatus as defined in claim 1 wherein said brake means is comprised of a plate member which frictionally engages the end of said at least one of said roll members, said plate member having a concave central portion and oppositely disposed end portions at least one of which having a substantially semi-circular recess provided therein.

4. The apparatus as defined in claim 3 further including means for applying a force to said plate member causing the axial movement of said plate member relative to said roll members to vary the amount of engagement of said at least one end of said plate member with said end of said at least one of said roll members.

5. The apparatus as defined in claim 4 wherein said force applying means comprises a screw threadedly received within said base member.

6. The apparatus as defined in claim 5 wherein said screw operatively contacts said concave central portion of said plate member causing said axial movement of said plate member relative to said roll members.

7. The apparatus as defined in claim 1 further including bushing means received within one end of said roll members so as to be adjacent said brake means.

8. The apparatus as defined in claim 7 further including bearing means received within the other end of said roll members.

9. The apparatus as defined in claim 1 further including means for retaining the roll of wrapping material on said base member, said retaining means being received through the core of the roll of wrapping material and operatively engaging said base member.

10. The apparatus as defined in claim 1 further including means for attaching said base member to the wrapping device.

* * * * *